United States Patent [19]

Peterson

[11] 4,300,745

[45] Nov. 17, 1981

[54] DEVICE FOR HANGING A DRAPERY ROD BRACKET ON WALLBOARD

[75] Inventor: Francis C. Peterson, St. Charles, Ill.

[73] Assignee: Illinois Tool Works Inc., Chicago, Ill.

[21] Appl. No.: 78,862

[22] Filed: Sep. 26, 1979

[51] Int. Cl.[3] ..... F16M 13/00

[52] U.S. Cl. ..... 248/546; 248/216.1; 248/217.1; 248/217.2; 248/262

[58] Field of Search ..... 248/216.1, 217.1, 217.2, 248/254, 262, 264, 267, 268, 546

[56] References Cited

U.S. PATENT DOCUMENTS

| | | | |
|---|---|---|---|
| 913,798 | 3/1909 | Young et al. | 248/267 |
| 1,306,114 | 6/1919 | Koval | 248/267 |
| 1,839,293 | 1/1932 | Boyce | 248/217.2 X |
| 1,884,414 | 10/1932 | Vroom | 248/262 |
| 2,751,807 | 6/1956 | Harre | 85/16 |
| 2,896,902 | 7/1959 | Graber | 248/262 |
| 2,973,175 | 2/1961 | Appleton | 248/217.2 |
| 3,298,651 | 1/1967 | Passer | 248/217.2 |

FOREIGN PATENT DOCUMENTS

| | | | |
|---|---|---|---|
| 199324 | 6/1908 | Fed. Rep. of Germany | 248/216.1 |
| 433876 | 9/1926 | Fed. Rep. of Germany | 248/217.2 |

*Primary Examiner*—William H. Schultz

*Attorney, Agent, or Firm*—J. R. Halvorsen; T. W. Buckman

[57] ABSTRACT

A mounting plate assembly for securing a curtain rod bracket to dry wall or the like. The assembly includes radiused anchors which are easily rotated into the wall. The anchors may be constructed individually and then incorporated into the assembly or, in an alternate embodiment, may be formed integrally with the mounting plate. The mounting plate employs a U-shaped flange and a plurality of spring fingers to removably retain the curtain rod bracket on the dry wall.

10 Claims, 6 Drawing Figures

DEVICE FOR HANGING A DRAPERY ROD BRACKET ON WALLBOARD

BACKGROUND AND SUMMARY OF THE INVENTION

A wide variety of suspension devices have been devised for hanging curtain rods. Nails and threaded fasteners in conjunction with various mounting plates form suitable means for some applications, as for example, where a wooden stud or window casing is available. For other types of wallboard applications, including dry wall, such anchors generally have inadequate pullout strengths to support the weight of the drapes, drapery rod and drapery rod brackets. Certain other expanding anchor fasteners have greater pullout values but are complicated to install (i.e., require predrilled holes, fastener insertion and removal), cannot be installed into a stud, are not readily removable from the wallboard, and do not always perform as they were designed to (i.e., occasionally the anchor will fail to collapse, the fastener head will be destroyed as a result of the high driving torque required, or the anchor will crush the wallboard).

It is an object of the present invention to provide an assembly for securing a drapery rod mounting bracket to wallboard which overcomes the above deficiencies of previous systems.

More particularly, it is an object of the present invention to provide a bracket-mounting assembly which can be easily installed using only a hammer.

Further, it is an object of the present invention to provide a bracket-mounting assembly which can be used in spite of the presence of an interfering stud.

It is an additional object of the present invention to provide a bracket-mounting assembly in which the anchor portion can be removed producing only a small, easily reparable slit.

These and other objects of the invention are accomplished by an assembly comprised of a number of anchors and a mounting plate which is generally rectangular in plan view and which is C-shaped in cross section. The C-shape is formed by the two edges, one of which is bent over upon itself (i.e., is configured in the form of a "U") and the other of which is bent generally perpendicularly to the plate body. This other edge has a plurality of spring fingers thereon at least some of which engage in openings in a curtain rod bracket to removably retain it in position with respect to the mounting plate.

In one embodiment of the invention, the anchors comprise arcuate projections which are integral with the mounting plate and curved out of the plane thereof. There are two sets of projections each set having a different uniform radius of curvature and projecting from one end of the plate.

In the second or preferred embodiment, the anchors are formed as separate arcuate hooks which penetrate the wallboard through slots in the mounting plate. The hooks have a set of pivot fingers projecting laterally outwardly, said pivot fingers engaging in apertures in the mounting plate to form the assembly. The center of curvature of the arcuate hooks lies along the axis of the pivot fingers so the hooks may be easily pivoted into the wallboard. The mounting plate has two sets of apertures and two sets of hook-receiving slots so the mounting plate may be turned either way for right and left-handed applications.

These and other objects, features and advantages of the present invention will be better understood by reference to the following detailed description taken in conjunction with the accompanying drawings.

DETAILED DESCRIPTION OF THE INVENTION

Figure 1:
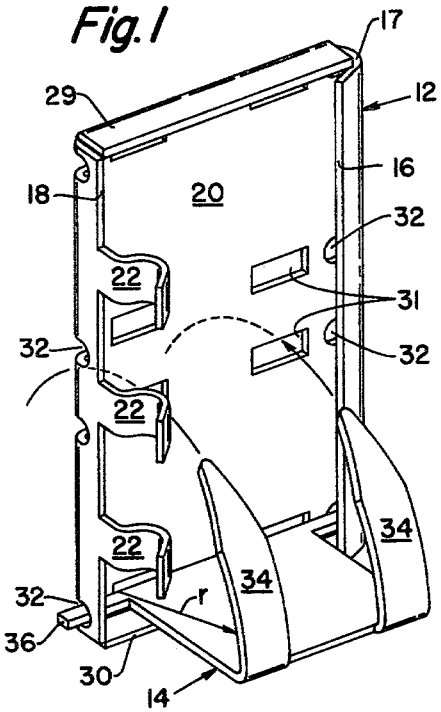
FIG. 1 is an isometric view of the left-handed configuration of the preferred embodiment of the present invention with one anchor shown in the assembled position.
Figure 2:
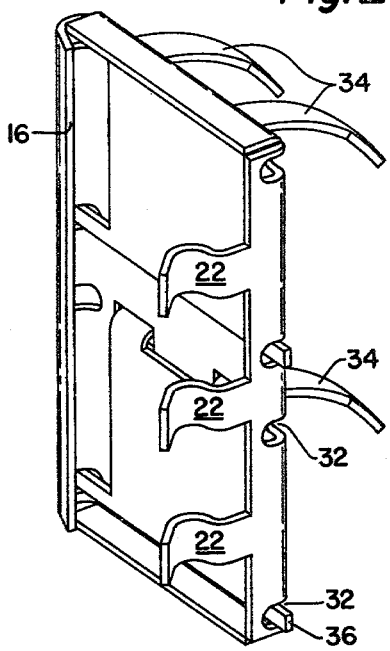
FIG. 2 is an isometric view of the right-handed configuration of the preferred embodiment shown with the anchors in wall engaging position.
Figure 6:
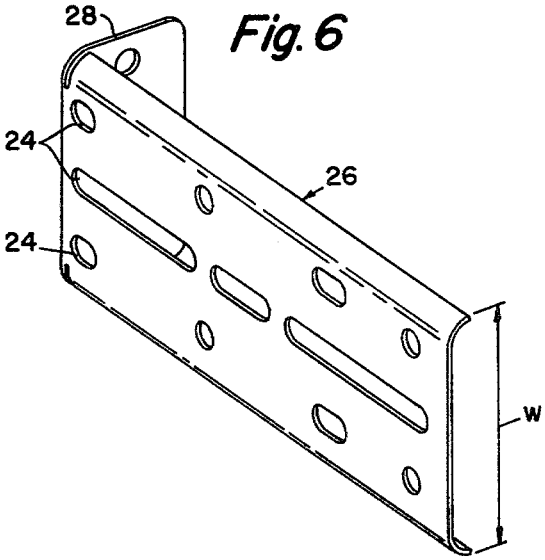
FIG. 6 is an isometric view of a typical mounting bracket with which the present invention may be used.

As shown in FIGS. 1 and 2, the preferred embodiment of the mounting assembly consists of a mounting plate 12 and a pair of anchoring means 14. The mounting plate 12 is generally rectangular as seen in plan view and is C-shaped in cross section. One edge 16 of the plate 12 is turned back upon itself to form a U-shaped portion 17 and the opposite edge 18 is bent in the same direction at generally a right angle to the body portion 20 of the plate. This edge 18 has a plurality of spring fingers 22 (three as shown in FIG. 1) which engage an equal plurality of similarly spaced apertures 24 in drapery rod bracket 26 (shown in FIG. 6). The end 28 of the bracket is slipped into U-shaped portion 17 of the wall-mounted plate 12 and the bracket 26 snapped into place. Upper and lower flanges 29 and 30 are spaced a distance equal to the width 'w' of bracket 26. The body portion 20 of the plate 12 has a plurality of slots 31 and apertures 32 therein for purposes set forth in more detail herebelow.

Each anchor means 14 comprises a set of wall penetrating hooks 34 projecting from one end and having a pair of laterally projecting pivot fingers 36 on the other. Hooks 34 have a uniform radius of curvature 'r' whose length corresponds to the length of the anchor 14. The axial projection of the hooks 34 is approximately equal to the thickness of the wallboard with which it is to be used. This length may, however, be more or less than the wall thickness without effecting performance substantially. The pivot fingers 36 are snapped into apertures 32 in the mounting plate 12 to retain the anchor means in assembled relationship with the mounting plate. The anchors 14 can be pivoted into the wallboard with hooks 34 projecting through slots 31. Because the radius of curvature of hooks 34 is equal to the length of the anchor, the anchor 14 can be easily pivoted about the axis of the pivot fingers 36 by simply pushing the anchor into the wallboard, or alternatively, striking the free end of anchor 14 with a hammer. It will be evident that the prong on hook 34 will readily penetrate a wooden stud if one is encountered.

Once installed, the torque transmitted to the mounting plate by the weight of the drapes, rods and brackets will act about lower flange 30. Since this edge is not located at the center of curvature of either anchor (and, hence, not at the center of rotation, either) rotation out of the wall is effectively discouraged. On the other hand, the mounting assembly can easily be removed by first removing the curtain rod bracket by exerting outward pressure on spring fingers 22 to extract them from apertures 24 and then rotating or sliding end 28 out of U-shaped portion 17. Then, by inserting a screw driver or other wedging means (not shown) between the anchors 12 and mounting plate 14 and rotating the anchors about the axis of the pivot fingers 36, the mounting plate can be removed from the wall. Removal will leave only a small slit in the wallboard having dimensions of the width and thickness of the hook 34. As shown in FIG. 1, mounting plate 12 has two sets of slots 31 and apertures 32 so that the same plate can be used to form both a left-handed (FIG. 1) and a right-handed (FIG. 2) assembly. The two sets of slots further make it possible for the two sets of hooks to be positioned either both inwardly or outwardly rather than as depicted in FIG. 1.

Figure 3:
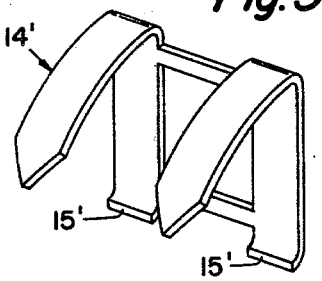
FIG. 3 depicts an alternate configuration for the anchoring means of the present invention.

As an alternative to the anchoring means used in FIGS. 1 and 2, an anchor 14' may be used (FIG. 3). This anchor eliminates the need for apertures 32 in the mounting plate. Curved ends 15' will instead, hook into the second set of slots 31 in the mounting plate. While less machining of the mounting plate is required when used with this alternative anchor configuration, this is not the preferred configuration since the anchors cannot be preassembled with the mounting plate. More manipulation will be required in installing the three separate pieces.

Figure 4:
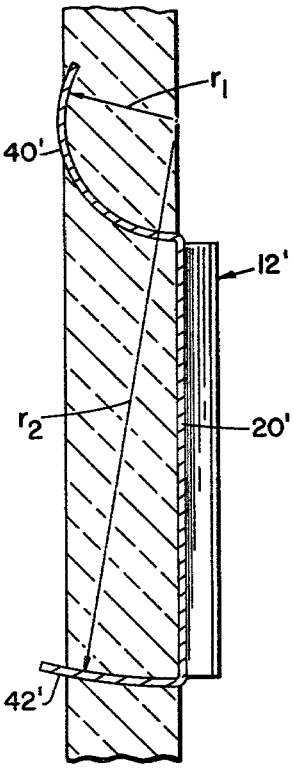
FIG. 4 shows a cross-sectional view of an alternate embodiment of the present invention.

FIG. 4 shows an alternate embodiment of the mounting assembly of the present invention. In this embodiment, the anchors are formed as integral parts of the mounting plate 12'. On one end of the plate, there are a pair of projections 40' arched out of the plane of the plate. These projections have a uniform radius of curvature '$r_1$' which is larger than the thickness of dry wall to which the mounting plate is to be anchored. Generally, the axial projection of the hooks is approximately equal to or slightly greater than the wallboard thickness. While this dimensional relationship is desired, it is by no means required and does not substantially effect the operation of the device. A second pair of projections 42' project from the opposite end of the plate 12' and have a second uniform radius of curvature '$r_2$' generally having the same center of curvature as '$r_1$'.

To insert this embodiment into the dry wall, the first projections 40' are positioned adjacent the wall with the body portion 20' extending upwardly. The projections are pushed into the wall with a rotating motion with the body portion 20' being rotated downwardly. The projections 20' will penetrate the rear surface of the dry wall and exert a slight spring force thereagainst as shown in FIG. 4. Should a stud be encountered, the projections 40' can be removed and their radius of curvature readjusted so that they will not completely penetrate the dry wall. Continued rotation of the mounting plate 12' will cause projections 42' to be rotated into the wall below the projections 40'. As in the first embodiment, these projections 40' are capable of penetrating and anchoring in the stud.

Loading of the mounting plate by the curtain rod bracket, curtain rod and curtain will tend to try to rotate the mounting plate 12 about its lower edge insuring that projections 42' will remain anchored in the wall. However, when unloaded, a simple 180° rotation of the mounting plate out of the plane of the wall about the upper edge of the plate will remove the mounting plate leaving, again, only four small slits which have the dimensions of the width and thickness of projections 40' and 42'. The primary disadvantage of this embodiment over the preferred embodiment is that there is less versatility with this mounting plate (i.e., there must be a definite right and left member).

Figure 5:
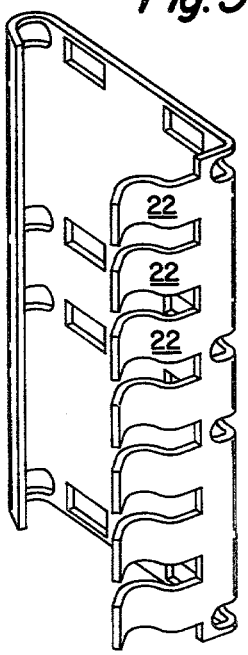
FIG. 5 is a plan view of a modification of the mounting plate which permits some adjustability.

FIG. 5 depicts a modification of the mounting plate spring fingers 22'. This modification consists of providing a plurality of fingers 22' in excess of the number of apertures 24 in the drapery rod bracket. The fingers 22' are of equal size, shape and spacing so that any three alternate fingers 22' can be used to retain the bracket. The upper and lower flanges of the FIG. 1 embodiment are omitted. In the embodiment shown in FIG. 5, this will permit adjustment to any of three various heights. This adjustability will make relocation of the mounting plate unnecessary where, for example, the installer has slightly misjudged the height at which he wishes to hang the drapes. This feature may, of course, be incorporated into either the separate anchor or integral anchor embodiments of FIG. 1 or 4.

While the invention has been described in conjunction with several embodiments thereof, it will be appreciated that various changes, modifications, and variations may occur to the ordinary artisan. Accordingly, it is intended that all such changes, modifications, and variations as fall within the scope of the appended claims be considered as coming within the spirit of the present invention.

I claim:

1. An assembly for securing a drapery rod to wallboard or the like, said assembly comprising anchor means a mounting plate means, and a bracket, said mounting plate means comprising a member which is generally rectangular in plan and C-shaped in cross section, one end of the "C" being formed by one edge of the plate means being turned back upon itself forming a U-shaped portion, the edge opposite to said one edge having a plurality of bracket-retaining spring fingers, said anchor means including at least two anchor members at least one thereof having one or more arcuate projection(s) for penetrating the wallboard and maintaining said mounting bracket means in fixed position with respect thereto, said bracket being a generally L-shaped member defined by a first shorter leg and a second longer leg said shorter leg having a free end and an end which adjoins said longer leg, said free end engaging in the U-shaped portion of said mounting plate means, said longer leg having a plurality of recesses equal in spacing for bracket retaining spring fingers, said fingers engaging in the recesses to maintain the bracket assembled to said mounting plate means.

2. The assembly of claim 1 wherein the anchor members comprise two sets of separate penetrating hooks, each set having two such hooks which form the arcuate projections and each of which has a wall penetrating anchoring portion on one end, each set of hooks being formed from a single piece of sheet metal and having a pair of pivot fingers formed integrally and extending laterally therefrom on the other end by means of which the anchor means are preassembled in a corresponding set of apertures in said mounting plate means.

3. The assembly of claim 2 wherein the anchor members are preassembled to the surface of the mounting plate means which is away from the wall and the anchoring portion of each anchor member is rotated into the wallboard through a set of slots in said plate means.

4. The assembly of claim 3 wherein the anchor hooks have a uniform radius of curvature and the pivot fingers lie at the centers of curvature therefor.

5. The assembly of claim 3 wherein the mounting plate means has a duplicate set of apertures and slots which mirror the first set in order to permit the same mounting plate means to be used as both a left and right-handed bracket mount.

6. The assembly of claim 1 wherein the mounting plate means has a flat body portion and a first anchor member comprises a first set of two projections formed integrally with, and arched out of the plane of, the flat body portion.

7. The assembly of claim 6 wherein the two projections have a uniform radius of curvature and extend from one end of the body portion said anchor means further comprising a second anchor member having two additional projections which extend from the opposite end of the body portion and in the same general direction as the first said projections.

8. The assembly of claim 7 wherein said two additional projections have a second uniform radius of curvature equal to the length of the mounting plate so that these second projections may be easily rotated into the wall.

9. The assembly of claim 1 wherein the spring fingers are equal in number to a plurality of apertures in the drapery bracket in which the spring fingers engage to releasably secure the bracket to said mounting plate means.

10. The assembly of claim 1 wherein the spring fingers are of a number which exceeds the number of apertures in the drapery bracket in order to permit vertical adjustment between the mounting plate and its associated bracket.

* * * * *